US005860619A

United States Patent [19]

Gulitz et al.

[11] Patent Number: 5,860,619

[45] Date of Patent: Jan. 19, 1999

[54] SEEKER HEAD

[75] Inventors: Wolfgang Gulitz; Johann Friedrich Egger, both of Überlingen, Germany

[73] Assignee: Bodenseewerk Geratetechnik GmbH, Uberlingen, Germany

[21] Appl. No.: 178,557

[22] Filed: Aug. 5, 1980

[30] Foreign Application Priority Data

Aug. 10, 1979 [DE] Germany ..... 29 32 468.3

[51] Int. Cl.[6] ..... F41G 7/22

[52] U.S. Cl. ..... 244/3.16

[58] Field of Search ..... 244/3.15, 3.16, 244/3.19

[56] References Cited

U.S. PATENT DOCUMENTS

| | | | |
|---|---|---|---|
| 2,911,167 | 11/1959 | Null et al. | 244/3.16 |
| 2,961,190 | 11/1960 | Miller et al. | 244/3.15 |
| 3,365,148 | 1/1968 | Preston et al. | 244/3.16 |
| 3,494,576 | 2/1970 | Lamelot | 244/3.16 |
| 3,617,016 | 11/1971 | Bolsey | 244/3.16 |
| 4,133,004 | 1/1979 | Fitts | 244/3.16 |

*Primary Examiner*—Michael J. Carone
*Assistant Examiner*—Christopher K. Montgomery
*Attorney, Agent, or Firm*—Keck, Mahin & Cate

[57] ABSTRACT

A seeker head comprises a seeker for scanning field of view and a gyro assembly sensing attitude variations. Signal processing means process information from two consecutive scans of the seeker. The signals from the gyro assembly are applied to a coordinate transformer circuit, which transforms the picture information from consecutive scans into a common intertial coordinate system. A target is selected by target selection logic. The coordinates of a selected target are read into a deviation memory. The signal processing means provide the inertial sight line rate of the sight line to a selected target. After each scanning and signal processing cycle the location is computed at which the target is to be expected according to the sight line rate measured during the preceding cycle. This permits comparison of target signals in consecutive scans even with moving targets, recovery of temporarily lost targets and discrimination between actual targets, such as an aircraft, and mocktargets, such as flares.

9 Claims, 12 Drawing Sheets

SEEKER HEAD

The invention relates to a seeker head comprising: a seeker having field of view scanning means for cyclically scanning the field of view and for providing picture informations referenced to a seeker-fixed coordinate system, a gyro assembly provided on the seeker and supplying attitude variation signals as a function of attitude variations of the seeker in inertial space, signal processing means for the joint processing of picture informations from two consecutive scans and comprising a coordinate transformer circuit to which the attitude variation signals are applied and which is arranged to transform the picture informations from consecutive scans into a common inertial coordinate system, a target selection logic to which the picture informations from two consecutive scans are applied and which makes a target selection therefrom, and a deviation memory into which the coordinates of a selected target are read by the target selection logic.

Such a seeker head is the subject matter of the main patent application Ser. No. 79,479 filed Sep. 25, 1979, now abandoned.

With a seeker head according to the main patent the picture informations received during a scan are transformed, in a first operation of each scanning and signal processing cycle, into an inertial coordinate system which coincided with the seeker-fixed coordinate system after completion of the preceding scan. The picture informations thus transformed with respect to their addresses are read into a first memory. Upon completion of each scan, the attitude variation signals, which are obtained from the signals of the gyro assembly by means of a coordinate transformer and integrator circuit and which represent the change of the seeker-fixed coordinate system relative to the attitude in inertial space existing after the completion of the preceding scan, are read into an end value memory. In a second operation the picture informations stored in the first memory are transformed, with the end values of the attitude variation signals stored in the end value memory, into an inertial coordinate system which coincided with the seeker-fixed coordinate system at the end of the scan. The picture informations thus transformed with respect to their addresses are read into a second memory.

The integrators of the coordinate transformer and integrator circuit are reset to zero at the end of each scan. When then, during the next scan, the picture informations are again transformed into the inertial coordinate system which coincided with the seeker-fixed coordinate system at the end of the preceding scan, i.e. the scan just considered, and the picture informations thus transformed are again read into the first memory, then the picture informations from two consecutive scans referenced to the same coordinate system are available in the first and second memories. A target selection logic is provided to which the data from the first and second memories may be applied. The target selection logic detects according to a "m-out-of-n"-method ($m \leqq n$), whether a picture signal provided by the seeker represents a target or not. When the same pixel provides a picture signal at least m times in n consecutive scans, this picture signal is recognized as target. This method permits recognition also of weak target signals in the white noise of the seeker.

The signal processing of the main patent application is suitable for stationary targets. When the target moves, additional measures are necessary, if the picture informations obtained with consecutive scans are to be compared.

Furthermore it may happen that a moving target cannot be observed temporarily. For example a tracked airplane may fly through a cloud. It is essential that the target will be found again even in this case as soon as it becomes visible again to the seeker.

Eventually it is known that fighter planes launch mock-targets (flares) as soon as they notice that they are tracked by a missile, in order to deceive the seeker head and to deviate the missile away from the aircraft and towards the mock-target. It is desirable for the seeker-head to discriminate between the tracked target, i.e. the aircraft, and the mock-target.

It is the object of the invention to modify a seeker head of the type defined in the beginning such that it provides the possibility to compare the target signals in consecutive scans even with moving targets, to recover a temporarily lost target and to discriminate between the actual target and a mock-target.

According to the invention this object is achieved in that (a) the signal processing means are adapted to provide the inertial sight line rate to the target after a target has been selected and, (b) after each scanning and signal processing cycle, to determine the location in the field of view in which the target is to be expected according to the sight line rate measured during the preceding cycles.

Thus according to the invention a location is determined by two or more scans in which location the target is to be expected during the next scan. With the "m-out-of-n"-method, for example, it can be checked whether a target signal appears at this location. If a target gets lost temporarily, a location defined by calculation is given with each scan in or near which location the target can be recovered. Eventually the determination of the location at or near which the target is to be expected with straight uniform movement permits discrimination between the actual target, which in first approximation moves this way, and a mock-target (flare) which naturally follows a trajectory different from that of the target (aircraft).

An embodiment of the invention is described in greater detail hereinbelow with reference to the accompanying drawings.

In the following it will be assumed that the seeker head of the invention is provided on a missile (rocket) which is used against intruding air targets (aircraft). The seeker head is to detect the air target in its field of view already at a rather large distance to distinguish it from other detected objects such as banks of clouds or the horizon and to guide the missile into the target.

Figure 1:
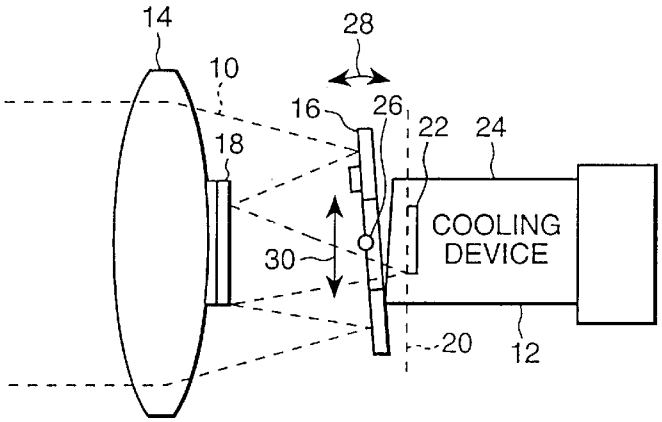
FIG. 1 shows schematically the opto-electronic part of the seeker head.

The optical system 10 of the seeker head comprises a lens 14 and two plane mirrors 16 and 18. Radiation from the object space is focussed by lens 14, as indicated in FIG. 1, the path of rays being folded by the two plane mirrors of which the annular plane mirror 16 is located behind the lens 14 and facing the same and the plane mirror 18 is affixed centrally to the rear face of the lens 14. Thus the lens 14 forms an image of the field of view as viewed by it in a plane 20. A linear array detector 22 is located in this plane 20. The plane mirror 16 is mounted for tilting movement about an axis 26 and is caused to oscillate about the axis 26 by a drive mechanism, as indicated by the double-arrow 28. Due to these oscillations the image of the field of view of is moved back and forth in the plane 20 relative to the linear array detector 22, as indicated by double-arrow 30. The linear array detector 22 consists of a linear array of photoelectric (or infrared sensitive) detectors 32, the linear array of the detectors 32 extending perpendicular to the direction of movement, as indicated by the double-arrow, of the image of the field of view. An angle encoder (not shown) is provided on the mirror axis 26.

Figure 3:
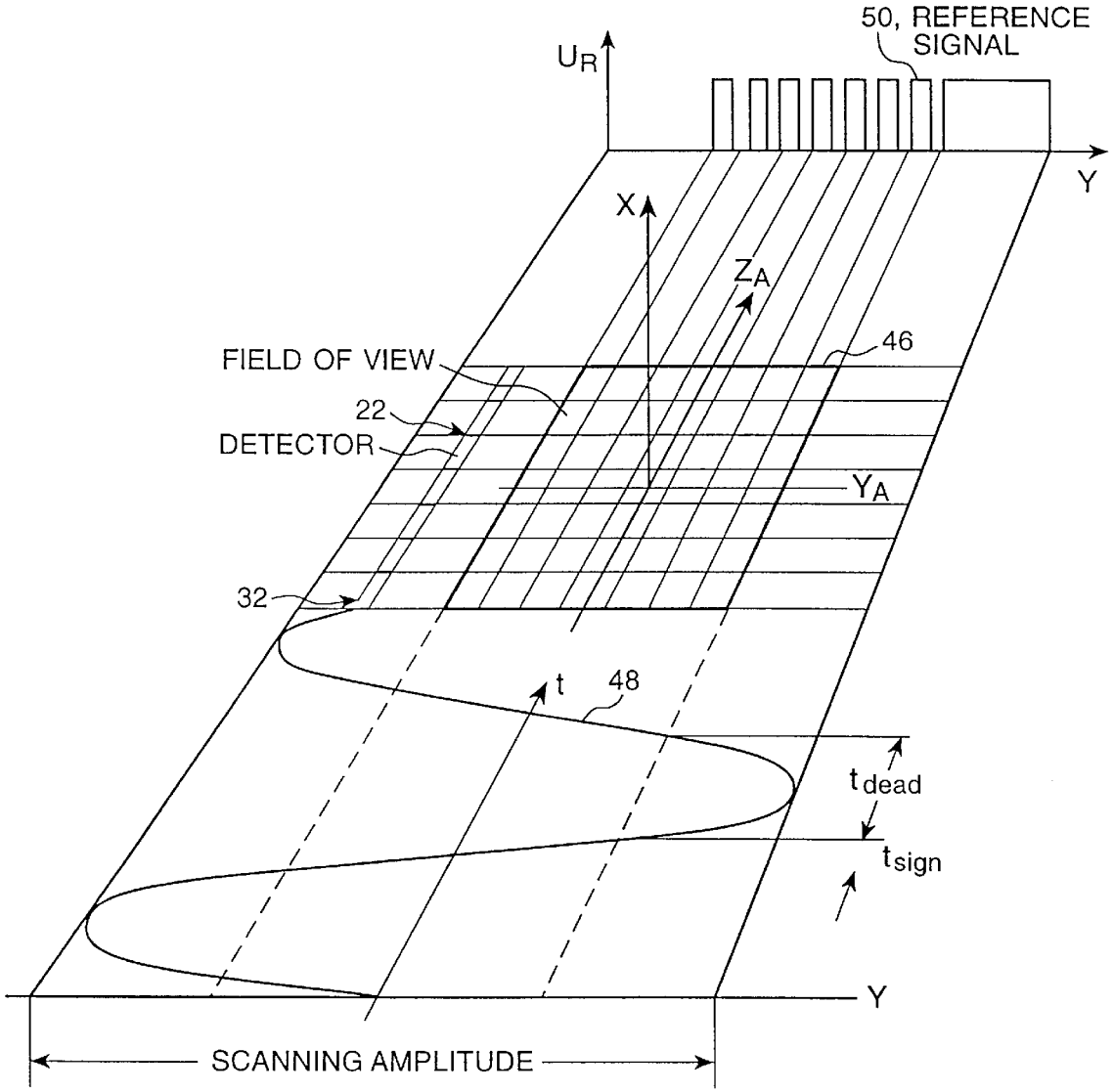
FIG. 3 illustrates schematically the scanning of the field of view with the seeker.

The scanning of the image of the field of view 46 is schematically illustrated in FIG. 3. In practice the linear array detector 22 is stationary as described and the image of the field of view oscillates due to the oscillating movement of the mirror 16. For the sake of more convenient illustration, however, the image of the field of view 46 has been regarded as stationary and the linear array detector 22 has been regarded as movable in FIG. 3.

The oscillation, which is illustrated by curve 48 in FIG. 3, extends beyond the field of view, whereby the field of view is scanned approximately uniformly. The scanning is effected alternatingly in one or the other direction (direction I and direction II), dead intervals being interposed between the scans. The signal processing takes place during these dead intervals.

The angle encoder generates reference pulses 50 (FIG. 3) by which the individual lines (in direction $Z_A$ in FIG. 3) are marked. The linear array detector 22 comprises fifteen detectors 32 and fifteen reference pulses 50 are generated during each scan whereby the field of view is subdivided into fifteen times fifteen pixel.

Figure 2:
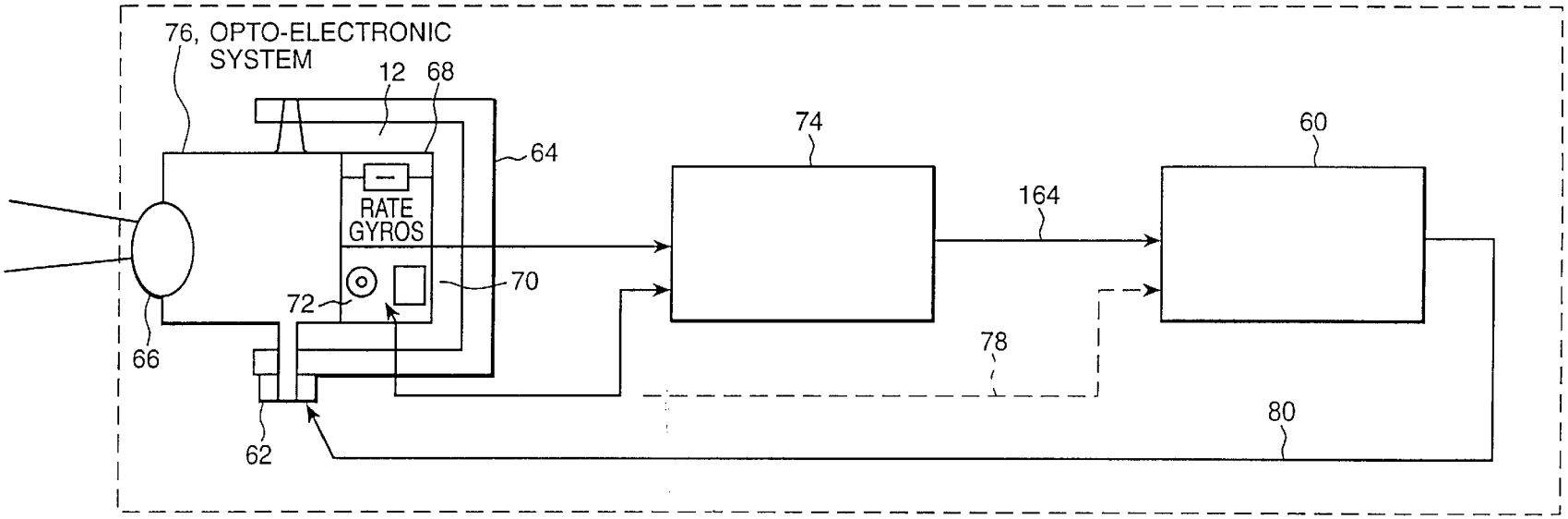
FIG. 2 shows schematically the cooperation of a seeker with a controller by which the seeker is oriented towards a target.

The seeker 12 is suspended on gimbals, as indicated in FIG. 2, and is adapted to be tilted relative to the gimbal 64 and to the seeker head 66 in accordance with controller signals which are provided by a controller 60.

Three rate gyros 68, 70 and 72 are mounted on the seeker and respond to the angular speeds $\omega_G$, $\omega_N$, and $\omega\varphi$ of the seeker 12 about the pitch, yaw and roll axes, respectively.

Numeral 74 designates signal processing means to which the picture informations of the opto-electronic system 76 of the seeker 12 and, in addition, the angular speed signals $\omega_G$, $\omega_N$, and $\omega\varphi$ from the rate gyros 68, 70, 72 are supplied. The signal processing means 74 apply output signals to the controller 60 to which also signals from the rate gyro are applied, as indicated by the dashed line 78. The controller 60, in turn, controls the torquer 62, as illustrated by line 80.

The field of view 46 is scanned cyclically. Picture informations from consecutive scans are processed together by the signal processing means. In order to be able to process picture informations from different scans together, these informations have to be referenced to a common inertial coordinate system. A seeker-fixed coordinate system as provided by the pixels of the described scanning of the image of the field of view 46 with line addresses and column adresses would not represent such a common inertial coordinate system. A stationary target would be displaced upwardly, if the seeker head 66 and thus the seeker 12 made a downward pitch movement. Therefore a picture element might be imaged on a quite different pixel during the second scan of the image of the field of view than during the first scan so that the seeker head is unable to "know" whether this is the same target or another one or whether the target moves or the seeker head pitches.

For this reason the signal processing means 74 comprise a coordinate transformer and integrator circuit to which the signals of the rate gyros 68, 70 and 72 are supplied and which provide attitude variation signals $Y_o$, $Z_o$, $\varphi$ therefrom in accordance with the attitude variations of a seeker-fixed coordinate system relative to an inertial coordinate system which at a predetermined moment, for example in the dead interval after the completion of the preceding scan, coincided with the seeker-fixed coordinate system. Thus all picture informations are referenced to one single inertial coordinate system. After completion of the scan the picture informations are transformed into an inertial coordinate system which coincided with the seeker-fixed coordinate system at the end of the scan, using the end values $Y_E$, $Z_E$, $\varphi_E$ of the signals provided by the coordinate transformer and integrator circuit. The picture informations are also transformed into this latter inertial coordinate system during the subsequent scan, whereby at this predetermined moment the picture informations from consecutive scans referenced, however, to the same coordinate system are available.

This is explained for a stationary target hereinbelow with reference to FIG. 5.

Figure 5:
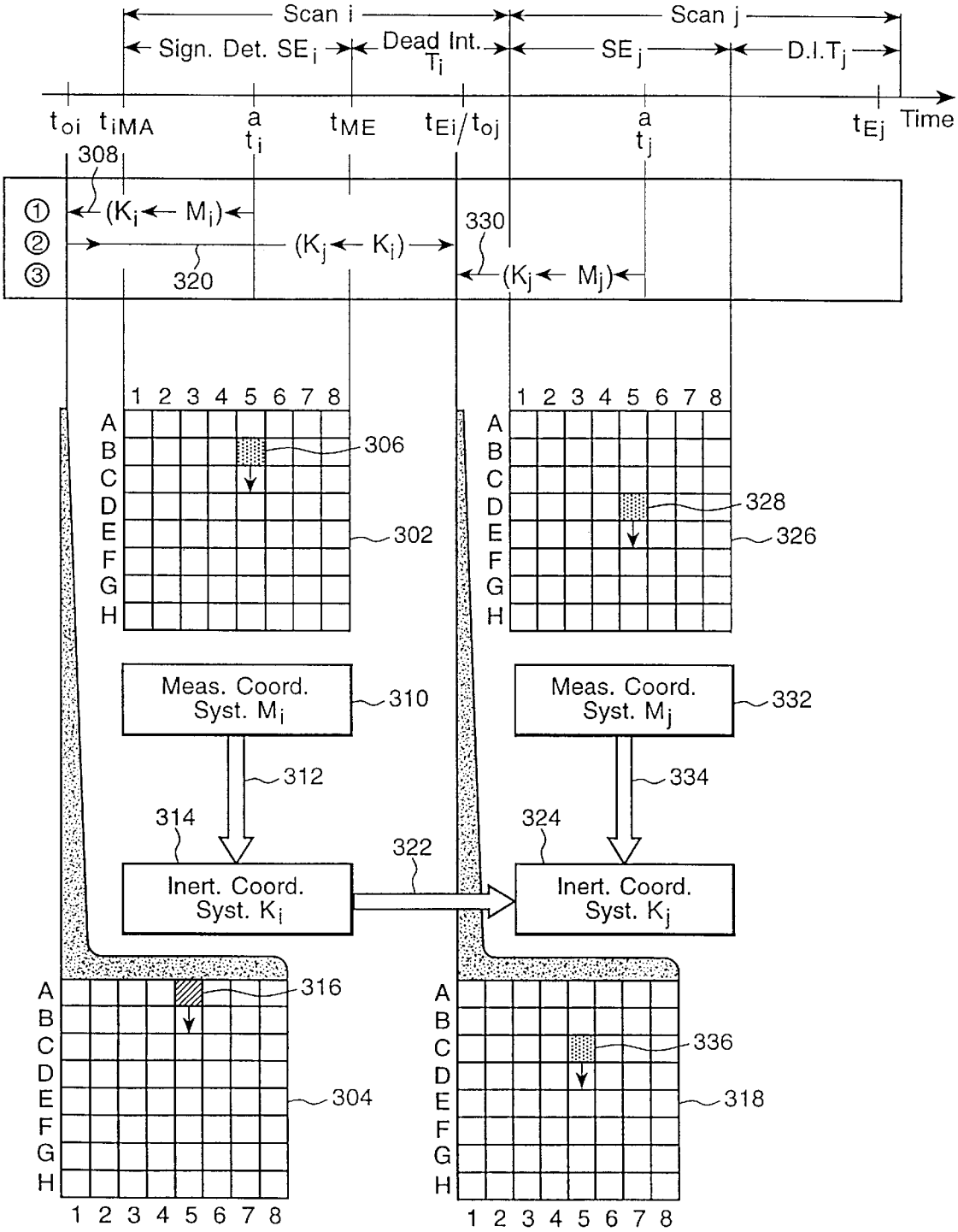
FIG. 5 is a schematic illustration and illustrates the coordinate transformations carried out during two consecutive scans in the case of a movement of the seeker but of a stationary target.

Referring to FIG. 5 numeral 302 designates the field of view picked up by the seeker 76 during a first scan which is subdivided into columns of pixels by the individual detectors of the linear array detector 22 and into lines by the reference pulses 50. Eight columns and eight lines are illustrated, the columns being designated A to H, and the lines being designated 1 to 8.

Each line corresponds to a certain moment on the time axis which is illustrated in the upper part of FIG. 5. The columns and lines of this field of view define a seeker-fixed coordinate system, which will be designated "measured coordinate system" $M_i$ hereinbelow.

The picture informations which have been obtained in the measuring coordinate system $M_i$ are transformed into an inertial coordinate system 304 which coincided with the measuring coordinate system $M_i$ at a predetermined moment $t_{oi}$ and which will be designated as "inertial coordinate system" $K_i$ hereinbelow. A target signal which is obtained from a pixel 306 is transformed into the inertial coordinate system $K_i$ in the course of the signal interval $SE_i$, as indicated by the arrow 308 as well as by block 310, arrow 312 and block 314. In the inertial coordinate system $K_i$ the target signal will, for example, appear in pixel 316, if a pitch movement of the seeker 76 is assumed.

During the dead interval $T_i$ but after the predetermined moment $t_{oj}$, the stored picture information is transformed into an inertial coordinate system which coincided with the seeker-fixed coordinate system at a predetermined moment $t_{oj}$ and which will be designated inertial coordinate system $K_j$ hereinbelow. This is symbolised by the arrow 320 as well as by arrow 322 and block 324.

There is a second scan of the field of view, another seeker-fixed coordinate system 326 being now defined and being designated measuring coordinate system $M_j$. During this second scan the target appears in pixel 328 of the measuring coordinate system $M_j$. Also during this scan the picture informations are transformed into the associated inertial coordinate system $K_j$, as indicated by arrow 330 as well as by block 332, arrow 334 and block 324. After the signal acquisition interval $SE_j$ the picture informations from both scans referenced to the same coordinate system $K_j$ are available. A stationary target appears in the same pixel 336 of the inertial coordinate system $K_j$ with both scans.

In FIG. 5 and in the remaining Figures $$K_i \leftarrow M_i$$

designates, for example, the coordinate transformation from the measuring coordinate system $M_i$ into the inertial coordinate system $K_i$.

This mode of operation is the subject matter of the main patent application and has been described in detail there.

Figure 6:
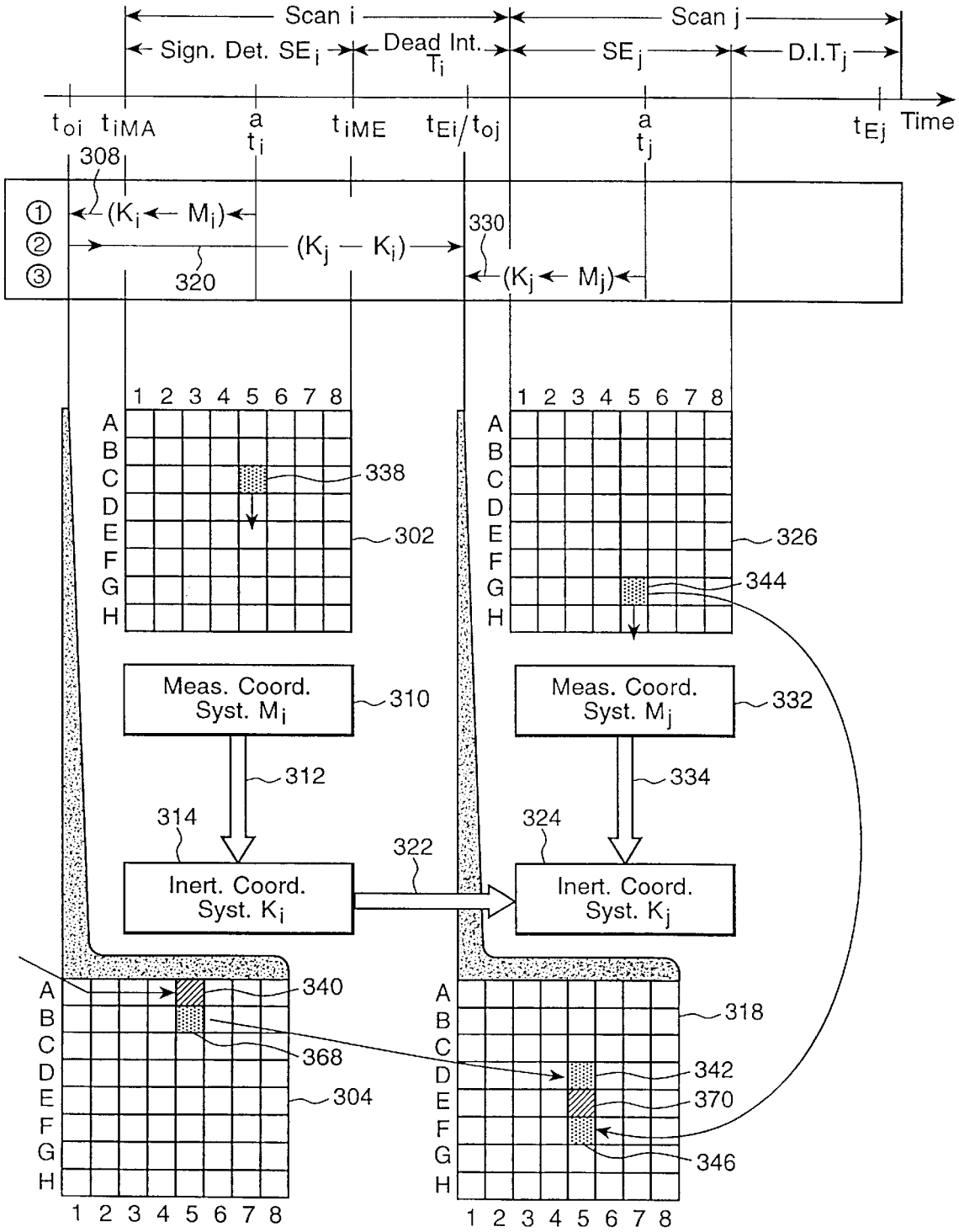
FIG. 6 is an illustration similar to FIG. 5 but with a moving target.

FIG. 6 shows in the same mode of illustration as FIG. 5 the situation with a moving target. Corresponding elements bear the same reference numerals in FIG. 6 as in FIG. 5.

With the first scan a target is detected in pixel 338 in the measuring coordinate system $M_i$. The coordinate transformation $K_i \leftarrow M_i$ brings the target into pixel 340 of the inertial coordinate system $K_i$. When after completion of the first scan the picture informations are transformed from the inertial coordinate system $K_i$ into the inertial coordinate system $K_j$, the target will appear in pixel 342 of this coordinate system $K_j$. During the second scan the target appears in pixel 344. A transformation $K_j \leftarrow M_i$ transforms the pixel 344 of the measuring coordinate system $M_j$ into the pixel 346 of the inertial coordinate system $K_j$. This pixel is offset to the bottom by two colums relative to pixel 342. This offset represents the movement of the target itself referenced to the inertial coordinate system $K_j$. The inertial sight line rate $\dot{\sigma}$ may be derived from the offset and the scanning frequency.

Figure 4:
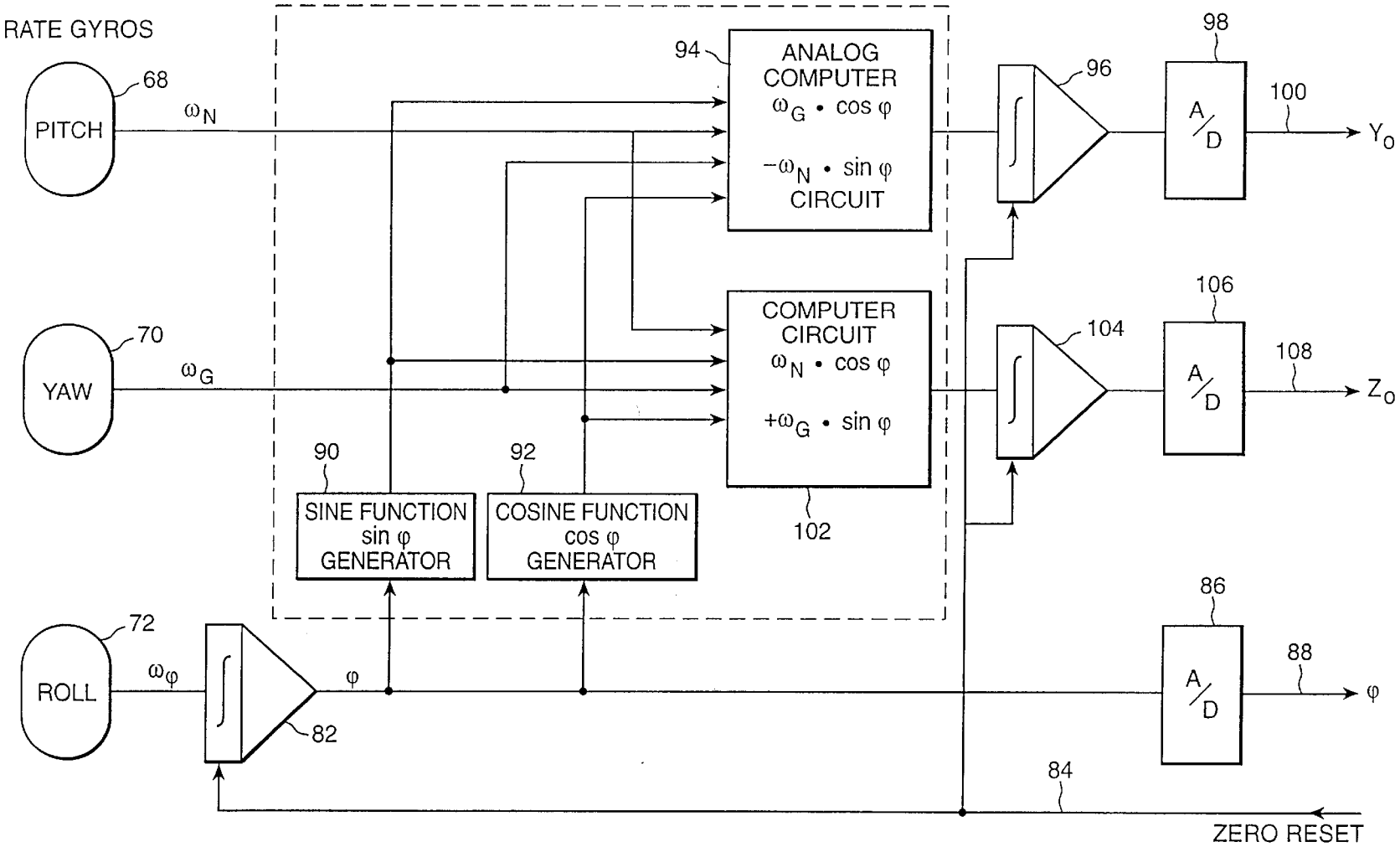
FIG. 4 shows schematically an analog coordinate transformer and integrator circuit for generating signals which represent the attitude variations of the seeker-fixed coordinate system in inertial space.

FIG. 4 shows the coordinate transformer and integrator circuit which provides the transformation parameter at first for the coordinate transformation $K_i \leftarrow M_i$ or $K_j \leftarrow M_j$, respectively, and then for the coordinate transformation $K_i \rightarrow K_j$ etc. from the signal of the three rate gyros 68, 70 and 72.

The roll gyro 72 provides as output signal the angular speed $\omega\varphi$ of the seeker head about the roll axis. This angular speed $\omega\varphi$ is integrated by means of an integrator 82. The integrator is reset to zero by a signal R on line 84 after each scan of the field of view. Therefore it provides the angle $\varphi$ through which the seeker head 12 has rotated about its roll axis since the last scan of the image of the field of view 42. This angle $\varphi$ is digitalized by an analog-to-digital converter 86 and is available at an output 88. The output signal of the integrator 82 is applied to a sine function generator 90 and to a cosine function generator 92 which provide signals representing sin $\varphi$ and cos $\varphi$, respectively. The signals sin $\varphi$ and cos $\varphi$ as well as signals analog to the angular speeds $\omega_G$ and $\omega_N$ about yaw and pitch axes from the yaw and pitch gyro 70 and 68, respectively, are applied to an analog computer circuit 94. The computer circuit 94 forms $$\dot{Y}_o = \omega_G \cos\varphi - \omega_N \sin\varphi$$

This signal is integrated by means of an integrator 96, which is also arranged to be reset to zero by the signal R on line 84. The output signal of the integrator 96 is then analog to the transversal displacement $Y_o$ of the coordinate system. This analog output signal is converted into a corresponding digital word at an output 100 by an analog-to-digital converter 98.

In similar manner the signals sin $\varphi$ and cos $\varphi$ gas well as the signals $\omega_G$ and $\omega_N$ are applied to a computer circuit 102. The computer circuit 102 forms $$\dot{Z}_o = \omega_N \cos\varphi + \omega_G \sin\varphi.$$

The output signal of the computer circuit 102 is integrated by means of an integrator 104, which is also arranged to be reset to zero by the signal on line 84. Then the output signal of the integrator 104 is analog to the transversal displacement $Z_o$ of the coordinate system. This analog output signal is converted into a corresponding digital word at an output 108 by an analog-to-digital converter 106.

Thus the circuit of FIG. 4 provides the three attitude deviation signals $Y_o$, $Z_o$ and $\varphi$ in digital form.

The signal processing means are illustrated in their various phases as block diagrams in FIGS. 7 to 13, the respective active elements being drawn in thick solid lines.

Numeral 348 designates a coordinate transformer, to which the coordinates of the various pixels are supplied and which carries out a coordinate transformation therewith in accordance with the output signals $Y_o, Z_o, \varphi$ of the coordinate transformer and integrator circuit (FIG. 4) or with the end values $Y_E, Z_E, \varphi_E$ of these output signals stored in an end value memory at the end of a scan at the moment $t_{oj}$. This has been described in detail in the main patent. A first memory 350, a second memory 352, a third memory 354 and a fourth memory 356 are provided. The picture informations contained in the memories may be applied to a target selection logic 358.

Numeral 360 designates a computer which is adapted for floating averaging for forming a mean value of the inertial sight line rate $\dot{\sigma}$. A coordinate transformer 362 causes coordinate transformation of the mean value used during the preceding scan into the inertial coordinate system associated with the respective present scan so that a new averaging may take place with the value of the inertial sight line rate obtained in this inertial coordinate system. On the basis of this mean value of the sight line rate the adresseses of the picture informations stored in the third and fourth memories are corrected by a correcting unit.

The target selection logic 358 supplies a signal to a target deviation computer 366.

Figure 7:
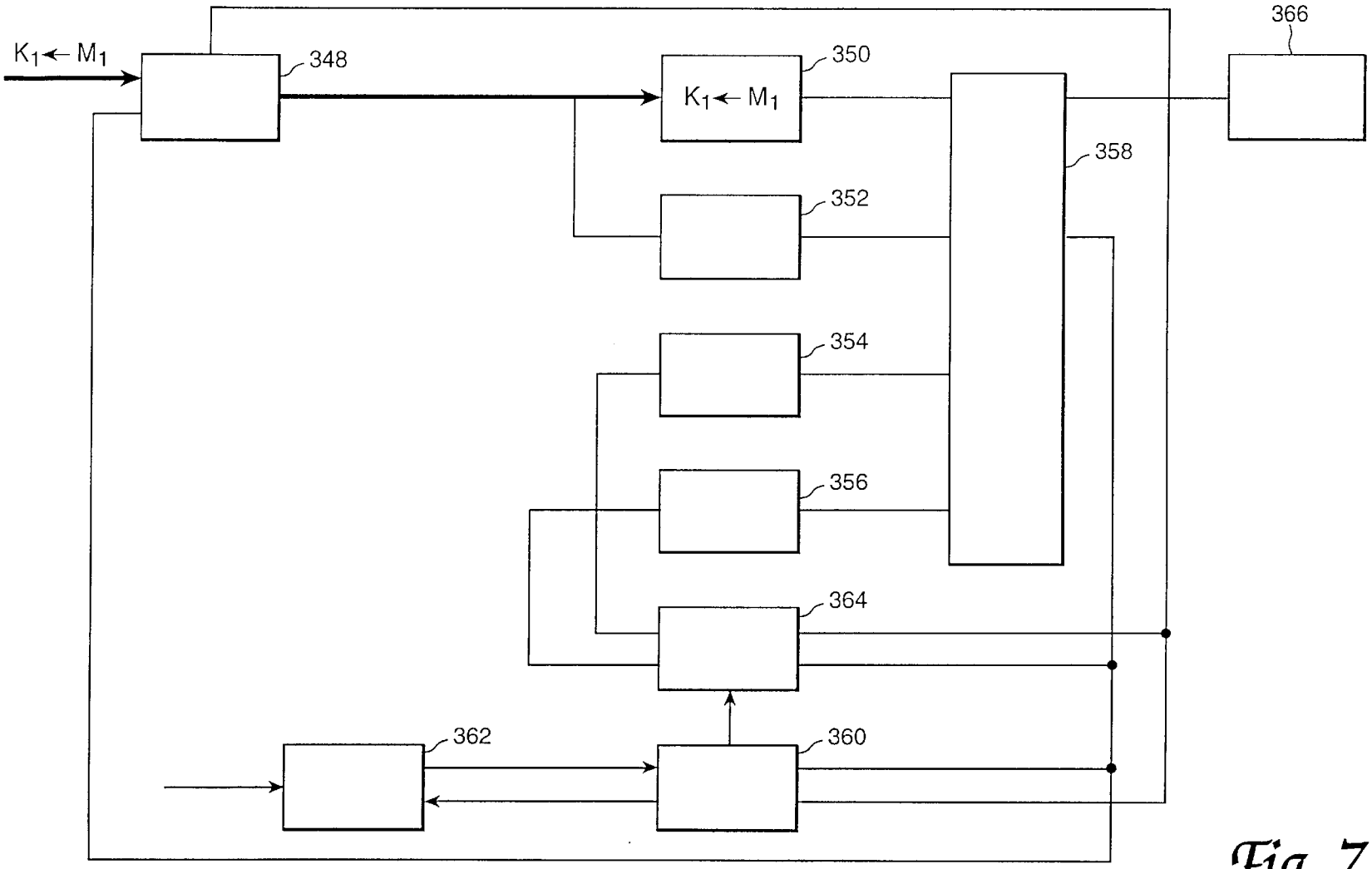
FIG. 7 is a schematic illustration of the signal processing means during a first scan of the field of view.
Figure 8:
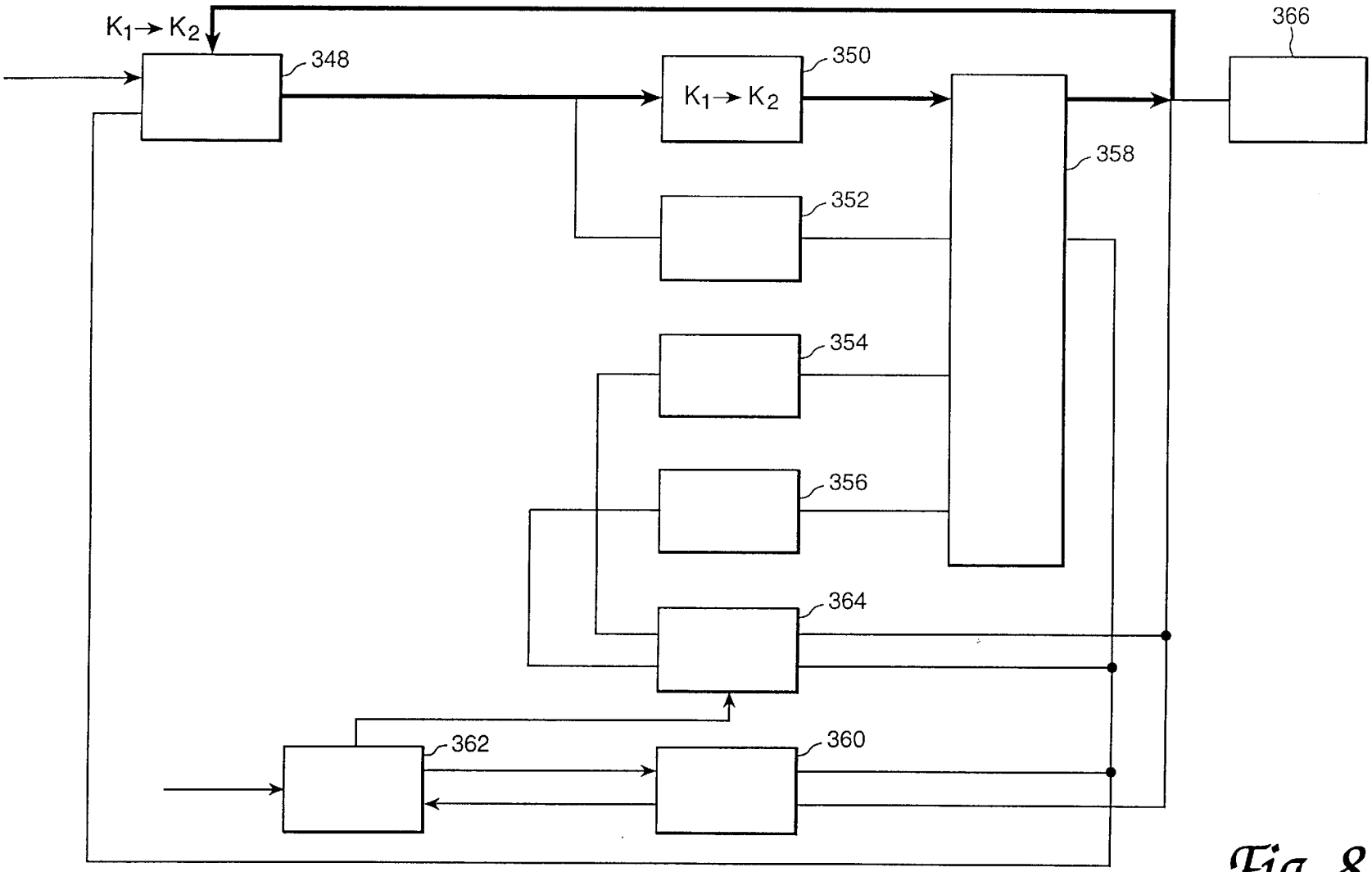
FIG. 8 is a schematic illustration of the signal processing means during the dead interval following the first scan.

The mode of operation of the described arrangement is as follows:

As illustrated in FIG. 7, the picture informations obtained in the measuring coordinate system $M_1$ with the first scan are transformed into the inertial coordinate system $K_1$ by a coordinate transformation $K_1 \leftarrow M_1$ by means of a coordinate transformer 348. The picture informations thus transformed are read into the first memory 350.

By the next step (FIG. 8) the picture informations from the first memory 350 are applied to the target selection logic 358 during the dead interval following the first scan. When the target selection logic 358 recognizes a possible target, the target coordinates are transformed by the coordinate transformer 348 into the inertial coordinate system $K_2$ associated with the next signal acquisition ($K_1 \rightarrow K_2$). The target signals thus transformed with respect to their addresses are again read into the first memory 350, the picture informations stored therein previously being overwritten. Thus the first memory 350 contains the target picture informations referenced to the inertial coordinate system $K_2$.

Figure 9:
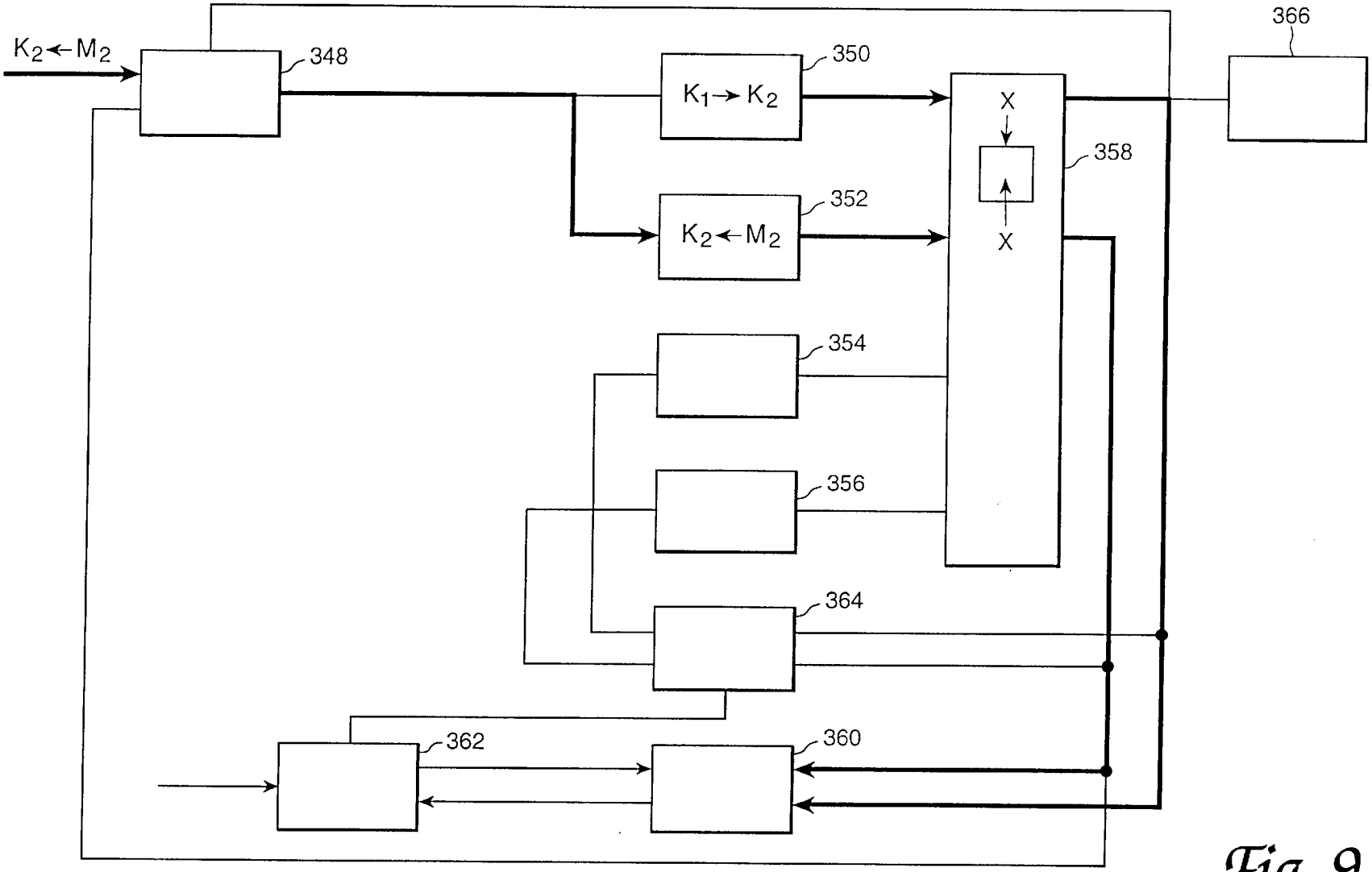
FIG. 9 is an illustration of the signal processing means similar to FIG. 7 during the subsequent second scan of the field of view.

FIG. 9 shows the next scan which provides the picture information in a seeker-fixed measuring coordinate system $M_2$. The coordinate transformer transforms the picture informations into the inertial coordinate system $K_2$. The picture informations thus transformed are read into the second memory 352. After the signal acquisition of this scan the picture informations of the second scan are available in the second memory and the picture informations of the first scan are available in the first memory 350, both informations being referenced to the same inertial coordinate system. The two storage contents are applied to the target selection logic 358, where the pictures are compared.

It is checked, as indicated in FIG. 9, whether a new target picture information occurs within a "window" defined around the target recognized first. A target picture information appearing within such a "window" is assumed to originate from the same target. At first the "window" is made rather large for the purpose of target detection so that even a moving target appears within the "window" during the second scan.

The coordinates of the two target picture informations are supplied to the computer 360 during the first part of the following dead interval, the computer calculating therefrom the inertial sight line rate or the average of the sight line rate referenced to the inertial coordinate system.

Figure 10:
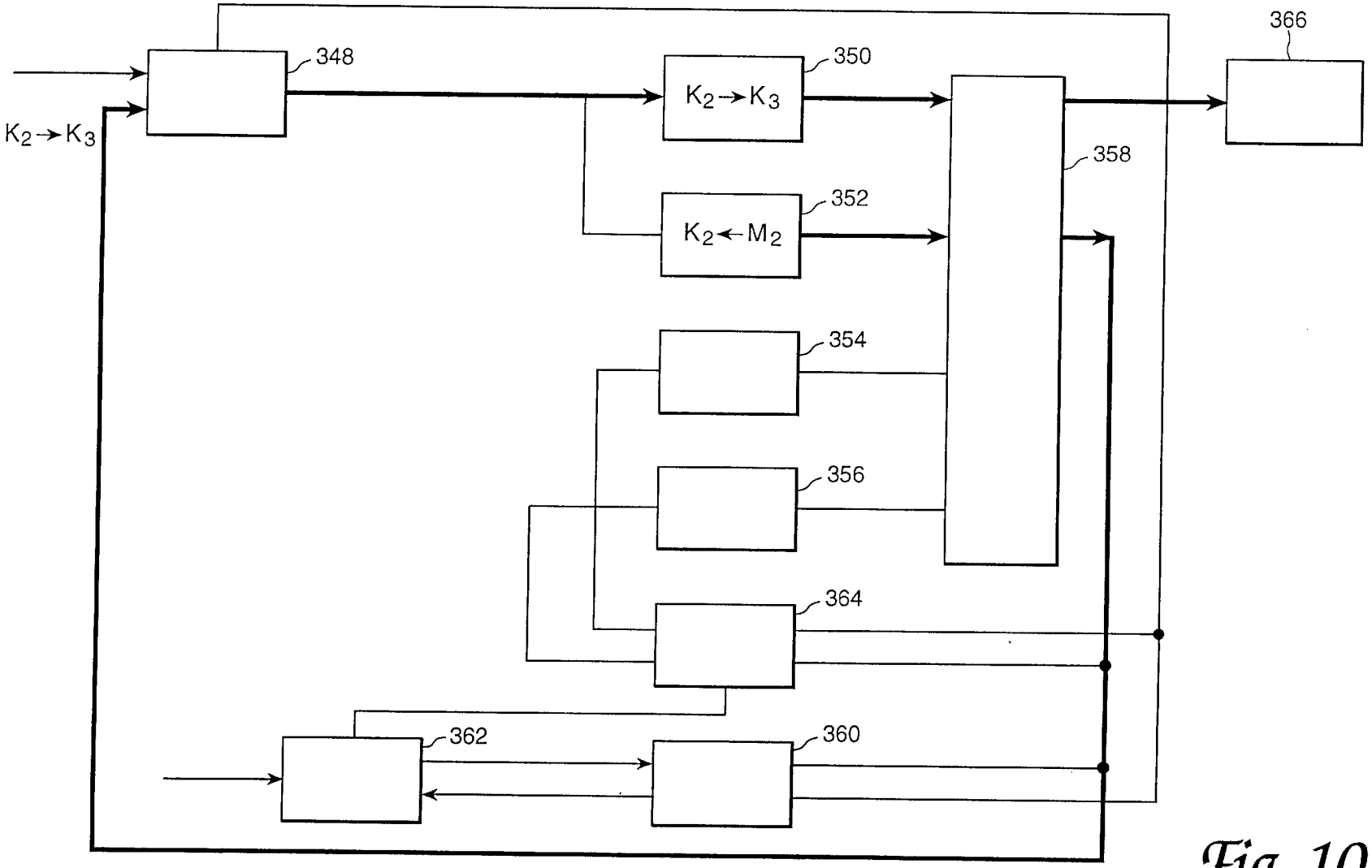
FIG. 10 is an illustration of the signal processing means during the dead interval following the second scan.

As illustrated in FIG. 10, the target picture informations from the second memory 352, i.e. the picture informations from the second scan referenced to the inertial coordinate system $K_2$, are transformed by the coordinate transformer 348 into the inertial coordinate system $K_3$ which is associated with the third scan. These transformed picture informations are read into the first memory 350.

The picture informations obtained with the third scan and obtained in the seeker-fixed measuring coordinate system $M_3$ are transformed into the coordinate system $K_3$ by the coordinate transformer. The picture informations thus transformed are read into the second memory 352. At the end of the third scan again the picture informations from the second and the third scan referenced to the same coordinate system $K_3$ are available. These picture informations are supplied to the target selection logic. The target picture informations obtained from the storage contents of the first and second memories provided by the target selection logic 358 are supplied to the third memory 354 and the fourth memory 356 through the correction unit 364. The correction unit 364 is controlled by the computer 360. It provides the target picture informations as obtained from the storage contents of the first and second memories 350 and 352, respectively, but with a correction of the coordinates with respect to the inertial sight line rate $\dot{\sigma}$. This inertial sight line rate $\dot{\sigma}$ or its average are calculated by the computer 360 from the target picture informations of the first and second scans.

The correction of the coordinates of the target picture informations which are read into the third memory 354 from the first memory 350 through the target selection logic and the correction unit 364 corresponds to the variation of the sight line during the scanning interval, i.e. the time interval from the end of one scan to the end of the next one. The correction of the coordinates of the target picture informations which are read into the fourth memory 356 from the second memory through the target selection logic and the correction unit 364 correspond to the variation of the sight line $\dot{\sigma}$ during the time interval between the end of the preceding scan, the moment when the inertial coordinate system $K_3$ coincided with the seeker-fixed coordinate system $M_3$, and the moment when the pixel providing the target picture information was scanned.

This is illustrated in FIG. 6:

At the time $t_{oi}$ the seeker-fixed measuring coordinate system $M_i$ coincides with the inertial coordinate system $K_i$. At this moment the target image is located in pixel 340. The target image is scanned at the moment $t_i^a$. In the time interval from $t_{oi}$ to $t_i^a$ the target image has moved due to the movement of the target itself. If the pixel 338 scanned as target image at the moment $t_i^1$ is transformed into the inertial coordinate system $K_i$ without taking the movement of the target itself into account, the target picture information will appear in pixel 368. Transformed into the inertial coordinate system $K_j$ the pixel 368 will change into the pixel 370, while the pixel 340 will change into the pixel 342. The inertial sight line rate $\dot{\sigma}$ is derived from the distance of the pixels 342 and 346.

Because of the rather coarse raster of the seeker the measurement of the sight line rate $\dot{\sigma}$ is subject to inaccuracy. Therefore the mean value of the measured sight line rates is formed by the computer 360 by means of a floating averaging in accordance with the relation $$\bar{\vec{\dot{\sigma}}}(n) = \frac{l\,\bar{\vec{\dot{\sigma}}}(n-1) + \bar{\vec{\dot{\sigma}}}(n)}{l+1},$$

wherein $\bar{\vec{\dot{\sigma}}}$ (n−1) is the mean value of the vectorial sight line rate obtained in cycle n−1, $\bar{\vec{\dot{\sigma}}}$ (n) is the mean value obtained in cycle n, $\bar{\vec{\dot{\sigma}}}$ (n) the momentary value of the sight line rate obtained in cycle n, and n and n+1 are serial numbers of the cycles and 1 represents the weight factor for the averaging. In order to permit combination of the mean value $\bar{\vec{\dot{\sigma}}}$ (2) derived in the inertial coordinate system $K_2$, in the case of FIG. 11, with the momentary value $\dot{\sigma}$ (3) measured in the inertial coordinate system $K_3$, the mean value $\bar{\vec{\dot{\sigma}}}$ (2) from the computer 360 is supplied to a coordinate transformer 362, which receives the end values $Y_E$,$Z_E$, $\varphi_E$ of the coordinate transformer and integrator circuit of FIG. 4 and transforms the mean value $\bar{\vec{\dot{\sigma}}}$ (2) into the inertial coordinate system $K_3$.

Figure 11:
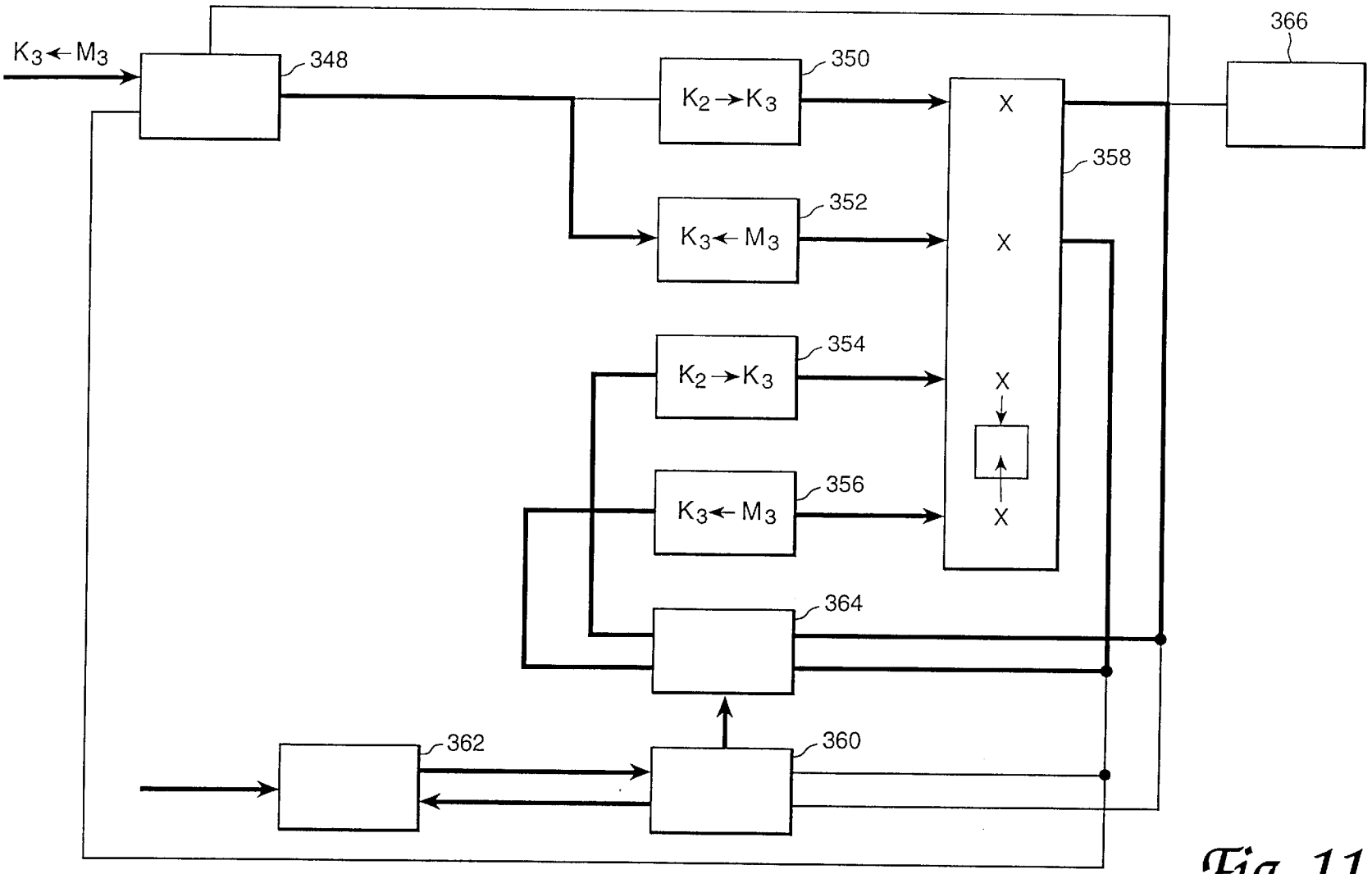
FIG. 11 is an illustration of the signal processing means similar to FIG. 7 during the subsequent third scan of the field of view.

The target picture information stored in the third memory 354 and corrected for the target speed defines a "window" around the pixel containing the target picture information, as indicated in FIG. 11. It can be expected that the target in the picture information stored in the fourth memory 356 and also corrected for the target speed is represented by the same or an adjacent pixel. Thus a target picture information from the fourth memory 356 and falling into the window can be regarded as originating from the same target. The window can be made very small in order to suppress secondary targets, for example flares launched by the aircraft. During the target tracking phase of FIG. 11 the window is substantially smaller than during the target detection in FIG. 9.

If no target picture information from the fourth memory 356 appears in the window in FIG. 11, what might be due to the fact that the target is only feebly perceptible in the noise and does not provide a target signal with each scan or that the target is covered temporarily, for example by clouds, the location in which the target is to be expected and around which the window is defined will be computed continuously by the computer 360 based on the last mean value of the sight line rate, until a target signal will appear again in the window. In order to take uncertainties and variations of the inertial sight line rate into account, the window is continuously increased with the time elapsed since the last target recognition.

Figure 12:
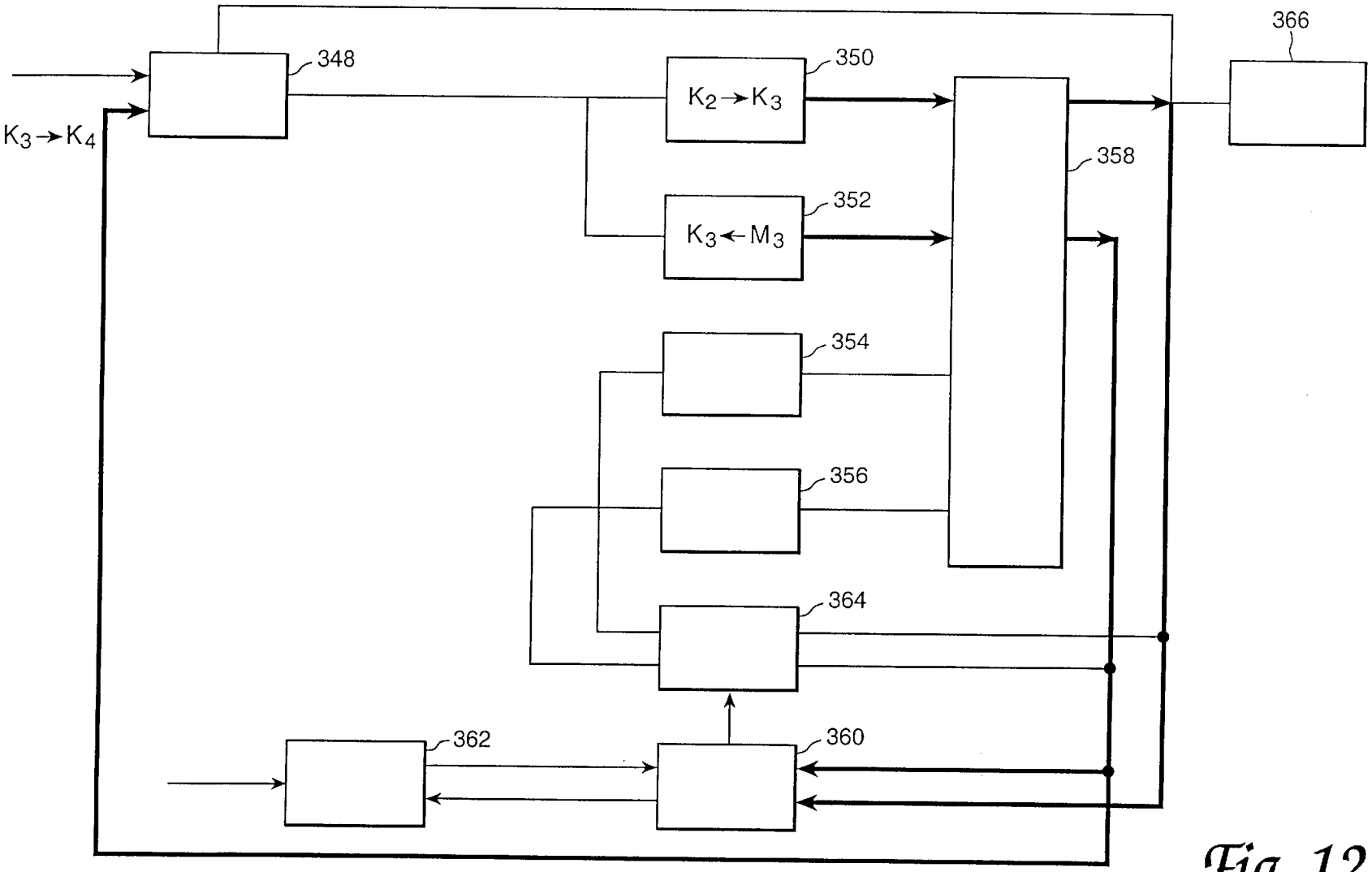
FIG. 12 is an illustration of the signal processing means during a first phase of the dead interval following the third scan.

As illustrated in FIG. 12, the inertial sight line rate $\dot{\sigma}$ (3) is again derived from the target picture informations contained in the memories 350 and 352, both informations being referenced to the inertial coordinate system $K_3$ and being supplied to the computer 360, this sight line rate $\dot{\sigma}$ (3) being used in the floating averaging.

At the same time the target picture informations from the second memory 352 are transformed by the coordinate transformer 348 into the inertial coordinate system $K_4$ which is associated with the fourth scan (FIG. 12) and is read into the first memory 350.

Figure 13:
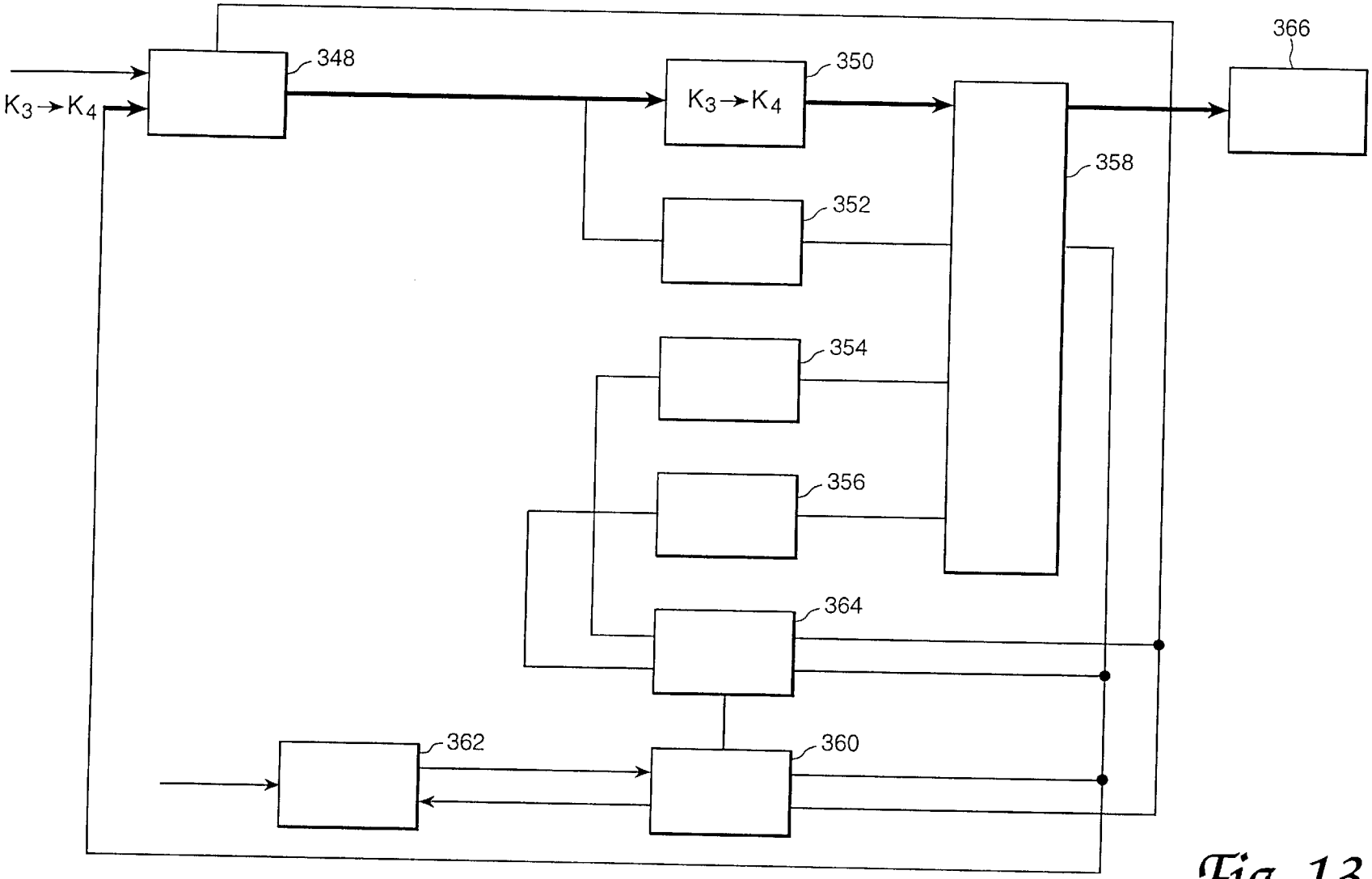
FIG. 13 is an illustration of the signal processing means during a second phase of this dead interval.

In accordance with FIG. 13 this transformed target picture information is then applied to the target deviation computer 366 via the target selection logic 358, said computer providing a target deviation signal, this target deviation signal tending to orient the seeker 76 towards the target.

What we claim is:

1. Seeker head comprising:

a seeker having field of view scanning means for cyclically scanning the field of view and for providing picture informations referenced to a seeker-fixed coordinate system, a gyro assembly provided on the seeker and supplying attitude variation signals as a function of attitude variations of the seeker in inertial space, and signal processing means for the joint processing of picture informations from two consecutive scans, and comprising a coordinate transformer circuit to which the attitude variation signals are applied and which is arranged to transform the picture informations from consecutive scans into a common inertial coordinate system, a target selection logic to which the picture informations from two consecutive scans are applied and which makes a target selection therefrom, and a deviation memory into which the coordinates of a selected target are read by the target selection logic, in which (a) the signal processing means are adapted to provide the inertial sight line rate to the target after a target has been selected and, (b) after each scanning and signal processing cycle, to determine the location in the field of view at which the target is to be expected according to the sight line rate measured during the preceding cycles.

2. Seeker head as set forth in claim 1, wherein (a) the signal processing means are adapted to form the average of the inertial sight line rate, by means of floating averaging, from the differences of the target coordinates during consecutive scans, and (b) the location in which the target is to be expected is determined, for each scanning and signal processing cycle, by the average of the sight line rate as provided during the preceding cycles.

3. Seeker head as set forth in claim 2, wherein (a) the average ($\dot{\sigma}$(n−1)) of the inertial sight line rate resulting from the preceding scanning and signal processing cycle, which is provided in an inertial coordinate system associated with this cycle, is transformed by the coordinate transformer circuit into an inertial coordinate system associated with the new cycle (A(n), (b) a sight line rate ($\dot{\sigma}$(n)) in this coordinate system is provided from the target coordinates resulting from the preceding and the new scan in the latter coordinate system, and (c) the signal processing means are adapted to form the average $\bar{\vec{\dot{\sigma}}}$ (n) in the latter coordinate system in accordance with the relation $$\bar{\vec{\dot{\sigma}}}(n) = \frac{l\,\bar{\vec{\dot{\sigma}}}(n-1) + \vec{\dot{\sigma}}(n)}{l+1}.$$

4. Seeker head as set forth in claim 1, wherein, (a) after the signal processing means have recognized a target, only the picture information within a "window" containing the recognized target is taken into account during the subsequent scanning and signal processing cycles, and, (b) during each scanning and signal processing cycle, the "window" is defined around the location which results from the target coordinates of the preceding cycle transformed into the inertial coordinate system associated with the new cycle and from the sight line rate as the target location to be expected.

5. Seeker head as set forth in claim 1, wherein the picture informations obtained in a seeker-fixed coordinate system during the scan are transformed into an inertial coordinate system associated with the respective scan and coinciding with the seeker-fixed coordinate system at a predetermined moment, wherein the respective transformed coordinates are corrected for the displacement of the selected target which displacement results from the sight line rate of the target and the time difference between the moment of the scanning and said predetermined moment.

6. Seeker head as set forth in claim 5, wherein the uncorrected target coordinates which are measured in the inertial coordinate system associated with the respective last scan or are transformed into this coordinate system, respectively, serve to measure the sight line rate.

7. Seeker head as set forth in claim 4, wherein, (a) if a target recognized by the target selection logic has got lost, a target location to be expected will be computed continuously by the signal processing means during the subsequent scanning and signal processing cycles taking into account the last measured target coordinates and the sight line rate measured prior to the loss of the target, the sight line rate being transformed into the inertial coordinate system of the respective cycle, and (b) a "window" the picture informations of which are processed is defined around this location.

8. Seeker head as set forth in claim 7, wherein the size of the window increases with the time elapsed since the loss of the target.

9. Seeker head as set forth in anyone of the claims 1 to 8, wherein (a) a first, a second, a third and a fourth memory (350, 352, 354, 356) are provided, (b) a coordinate transformer (348) is provided which is controlled by a resettable coordinate transformer and integrator circuit (FIG. 4) to which rate gyro signals ($\omega_N$, $\omega_G$, $\omega\varphi$) are applied or by an end value memory in which the end values of the output signals of said coordinate transformer and integrator circuit are stored after each scan, (c) the coordinate transformer (348) is adapted for coordinate transformation of the picture informations obtained in a seeker-fixed measuring coordinate system ($M_i$) during a scan into an inertial coordinate system ($K_i$) associated with the scan and for coordinate transformation from the inertial coordinate system ($K_i$) associated with the scan into the inertial coordinate system ($K_j$) associated with the next scan, (d) a target selection logic (358) is provided to which the picture informations from the memories (350, 352, 354, 356) are applied and which provides target picture informations of recognized targets, (e) the target picture informations, which are derived by the target selection logic (358) from the first and second memories (350, 352), are supplied to a computer (360) for floating averaging to provide a mean value of the inertial sight line rate ($\dot{\sigma}$), (f) these target picture informations, furthermore, are supplied to a correction unit (364) which is controlled by the computer (360) and corrects the target picture information for the target speed, (g) the target picture informations are read into the third and fourth memories, respectively (354, 356), and (h) the target selection logic (358) is adapted to make a picture comparison of the corrected target picture informations stored in the third and fourth memory (354, 356) for the purpose of target recognition.

* * * * *